US012305457B1

(12) United States Patent
Tang et al.

(10) Patent No.: US 12,305,457 B1
(45) Date of Patent: May 20, 2025

(54) DOWNHOLE TRACTOR DRIVE MODULE

(71) Applicant: Halliburton Energy Services, Inc., Houston, TX (US)

(72) Inventors: Shiao Loong Tang, Singapore (SG); Simon Shye Kwong Wai, Singapore (SG); Hock Soon Tiew, Singapore (SG); How Jiun Irvin Yuen, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/406,976

(22) Filed: Jan. 8, 2024

(51) Int. Cl.
*E21B 23/00* (2006.01)

(52) U.S. Cl.
CPC ..... *E21B 23/001* (2020.05)

(58) Field of Classification Search
CPC ..... E21B 23/001
See application file for complete search history.

(56) References Cited

U.S. PATENT DOCUMENTS 3,059,432 A * 10/1962 Thoma ..... F01B 3/0035 60/437
5,184,676 A 2/1993 Graham et al.
9,890,602 B2 2/2018 Guttormsen et al.
2015/0167416 A1* 6/2015 Ludwig ..... E21B 4/006 166/385
2015/0300113 A1 10/2015 Guttormsen et al.
2019/0048976 A1 2/2019 Armstrong

FOREIGN PATENT DOCUMENTS

WO WO-2008091157 A1 * 7/2008 ..... E21B 23/14
WO 2008/111844 A1 9/2008
WO 2022/093078 A1 5/2022

OTHER PUBLICATIONS

International Search Report; dated Sep. 25, 2024; Application # PCT/US2024/010726.

* cited by examiner

*Primary Examiner* — Cathleen R Hutchins
*Assistant Examiner* — Ronald R Runyan
(74) *Attorney, Agent, or Firm* — Polsinelli PC

(57) ABSTRACT

A downhole tractor drive module is provided. The downhole tractor drive module includes a first bevel gearbox, a first drive arm coupled to the first bevel gearbox, a connecting shaft, a second bevel gearbox, and a second drive arm coupled to the second bevel gearbox. The first bevel gearbox can include an input shaft in communication with the motor, a first output shaft, and a second output shaft coupled to a connecting shaft input connection. The second bevel gearbox can have an input shaft coupled to a connecting shaft output connection and a first output shaft.

16 Claims, 9 Drawing Sheets

DOWNHOLE TRACTOR DRIVE MODULE

FIELD

The present disclosure relates generally to tractor drive modules. In at least one example, the present disclosure relates to downhole tractor drive modules for a channel in a wellbore.

BACKGROUND

In pipelines and/or wellbores, tractors may be required to convey the long and heavy tools and tool strings to a designated location for specific operations. Such tractors typically have one or more pairs of drive arms, which can be hydraulically or mechanically opened to maintain contact against the interior walls of a channel or wellbore, such as a pipeline and/or a casing. In some examples, the drive arms can be electrically motorized to provide the tractive force required to move a tool or tool string within the channel.

BRIEF DESCRIPTION OF THE DRAWINGS

Implementations of the present technology will now be described, by way of example only, with reference to the attached figures, wherein.

DETAILED DESCRIPTION

Figure 1A:
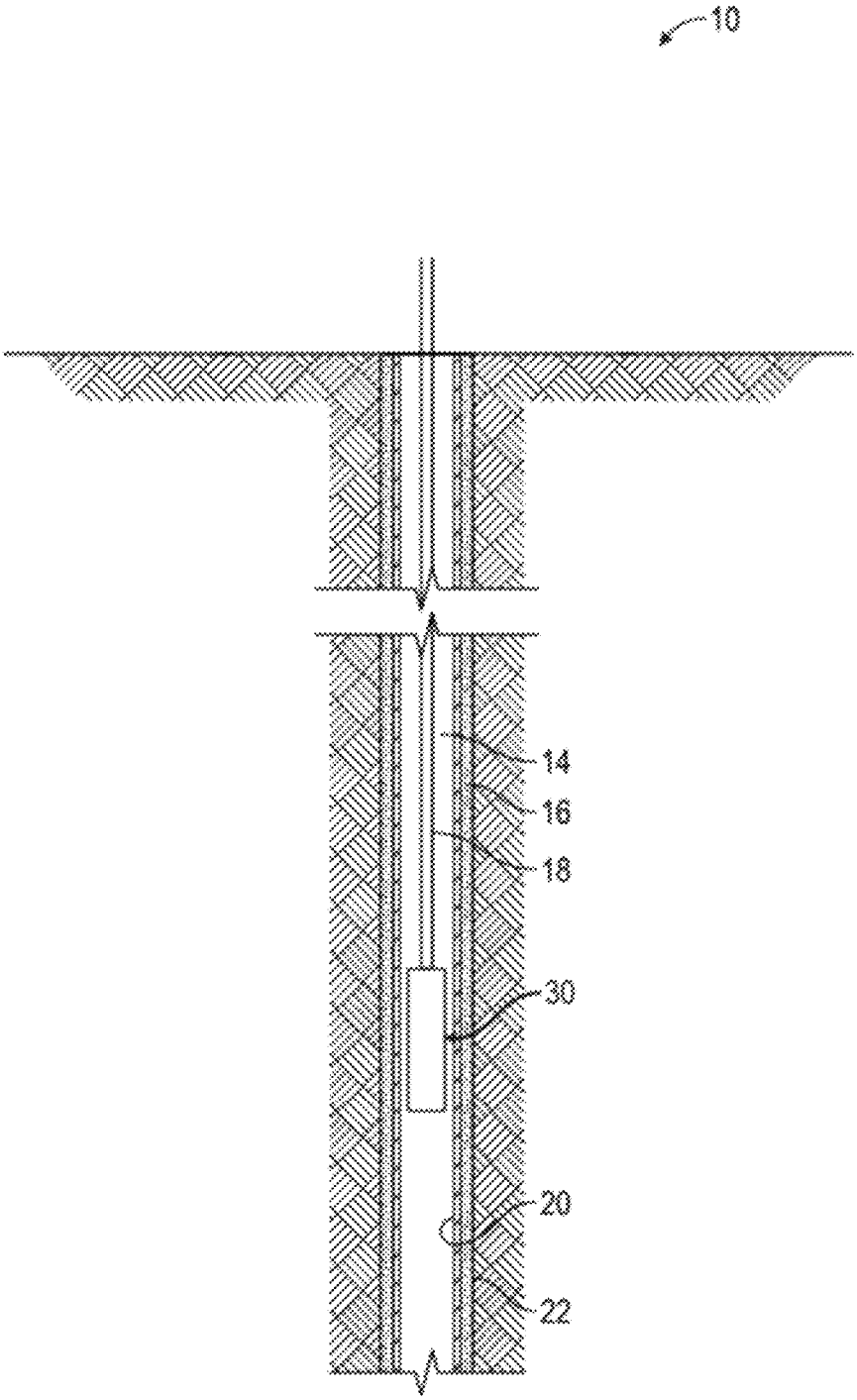
FIG. 1A is a diagram illustrating an exemplary environment for a tool with a tractor according to the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Disclosed herein is a downhole tractor drive module for conveying tools and tool strings within a wellbore. Typically, tractors, tools, and tool strings can be conveyed in wellbores via gravitational forces. However, in horizontal, slanted, and other non-vertical wells, tractive forces can be used to convey the tools and tool strings forward. In the case of deviated wells, a tractor, and specifically a tractor drive module, is necessary to convey the tools and tool strings throughout the wellbore. Current downhole tractor drive modules experience various limitations, such as long lengths (i.e., staggered configuration tractor drive modules) and inadequate structural integrity (i.e., scissor configuration tractor drive modules). Therefore, there is a need for a downhole tractor drive module that has a limited length for use in tight spaces as well as adequate structural integrity.

Figure 1B:
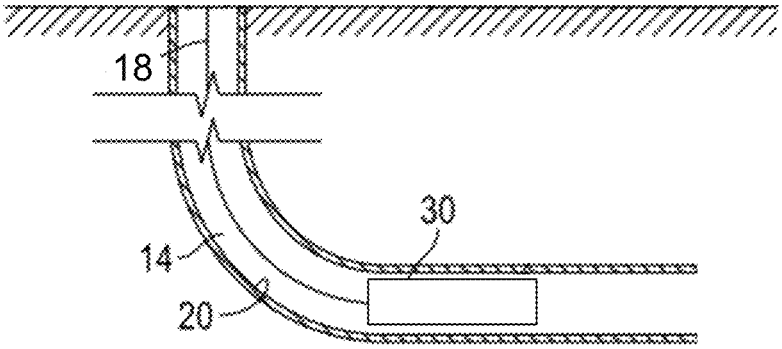
FIG. 1B is a diagram illustrating an exemplary environment for a tool with a tractor according to the present disclosure.

A downhole tractor drive module for a tractor 30 can be employed in an exemplary wellbore system 10 shown, for example, in FIGS. 1A-1B. The system 10 includes a tractor 30 traversing a wellbore 14.

As illustrated, for example, in FIG. 1A, the wellbore 14 is within an earth formation 22 and has a channel 20 lining the wellbore 14. In some examples, the channel 20 can include a pipeline. In some examples, the channel 20 can include a casing. In some examples, the channel 20 can be held into place by cement 16. The tractor 30 can be disposed within the channel 20 of the wellbore 14 and moved up and/or down the wellbore 14. In some examples, the tractor 30 can be coupled with a conduit 18. In some examples, the tractor 30 can be pulling the conduit 18 through the wellbore 14. The tractor 30 can include, for example, downhole sensors, chokes, and/or valves.

The conduit 18 can be, for example, wireline, slickline, work string, coiled tubing, and/or any other suitable means for conveying downhole tools using a tractor 30 into a wellbore 14. In some examples, the conduit 18 can include electrical and/or fiber optic cabling for carrying out communications. The conduit 18 can be sufficiently strong and flexible to tether to the tractor 30 through the wellbore 14, while also permitting communication through the conduit 18 to one or more of the processors which can include local and/or remote processors. In some examples, power can be supplied via the conduit 18 to meet power requirements of the tractor 30. For slickline or coiled tubing configurations, power for the tractor 30 can be supplied downhole with a battery and/or via a downhole generator.

It should be noted that while FIGS. 1A-B generally depict land-based operations, those skilled in the art would readily recognize that the principles described herein are equally applicable to operations that employ floating or sea-based platforms and rigs, without departing from the scope of the disclosure. As illustrated in FIG. 1B, the tractor 30 can be used in horizontal pipelines and/or wellbores. Further, the tractor 30 can be used in slanted pipelines and/or wellbores, multilateral pipelines and/or wellbores or the like. In some examples, the wellbore system 10 can have a channel 20 already implemented while, in other examples, the system 10 can also be used in open hole applications (e.g., no casing).

Figure 2A:
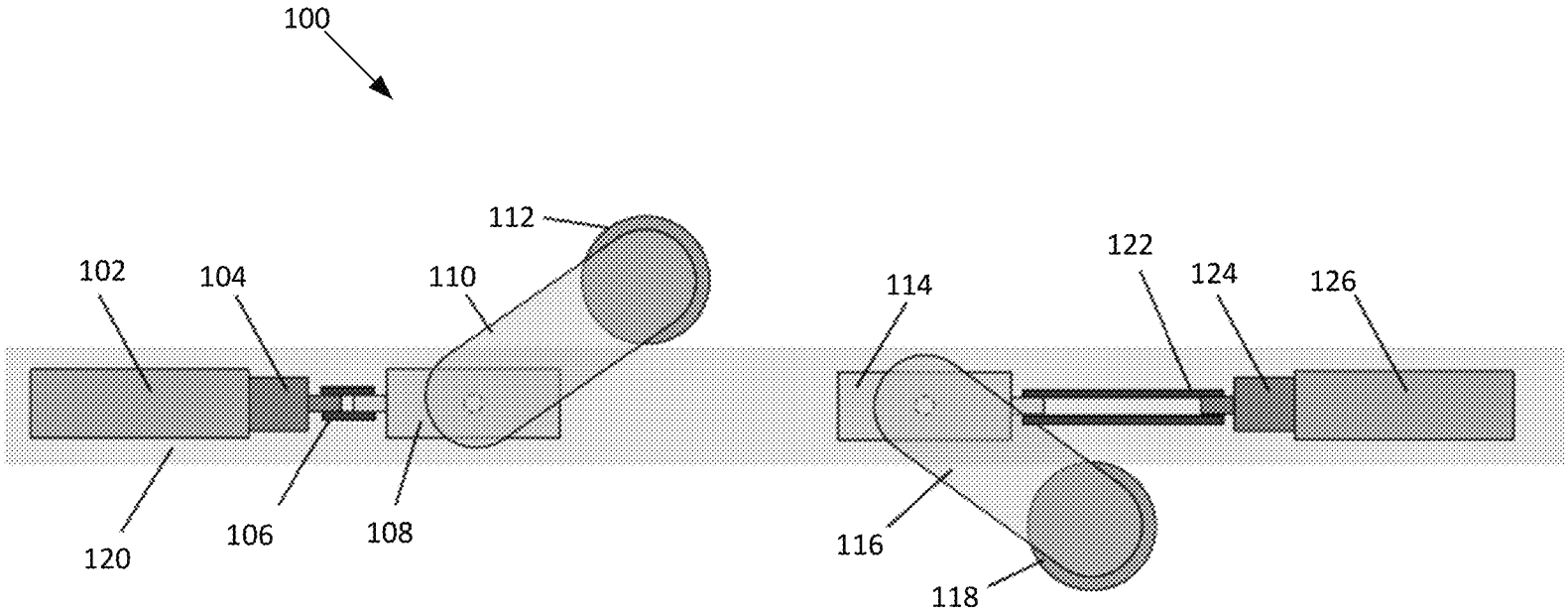
PRIOR ART FIG. 2A
FIG. 2A illustrates a downhole tractor drive module in a staggered configuration.
Figure 2B:
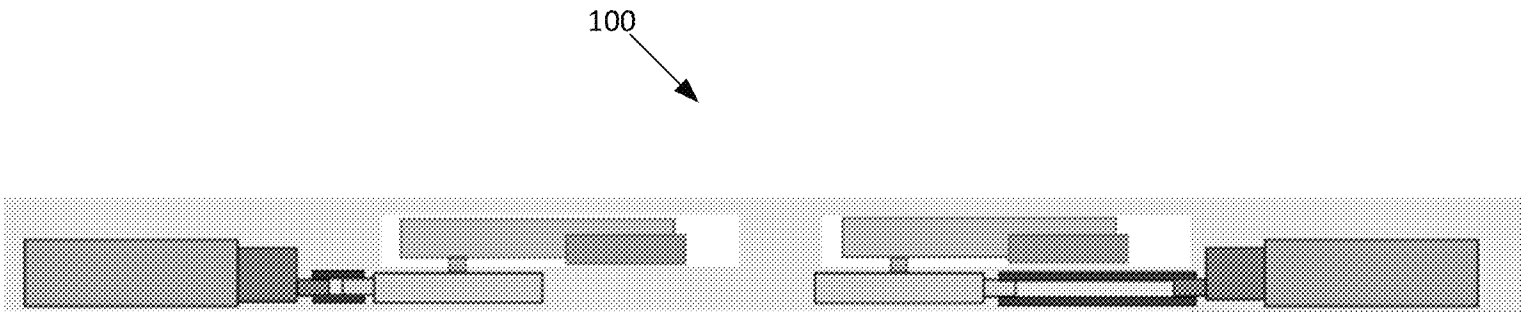
PRIOR ART FIG. 2B
FIG. 2B illustrates a downhole tractor drive module in a staggered configuration.

FIGS. 2A-2B illustrate a known staggered downhole tractor drive module 100. The known staggered downhole tractor drive module 100 includes a first motor 102 with a motor gearbox 104, a coupling mechanism 106, a first bevel gearbox 108, a first drive arm 110, and a first wheel 112. The known staggered downhole tractor drive module 100 further includes a second motor 126 with a second motor gearbox, a second coupling mechanism 122, a second bevel gearbox 114, a second drive arm 116, and a second wheel 118. The known staggered downhole tractor drive module 100 further includes a housing 120.

The known staggered downhole tractor drive module 100 requires that the first motor 102 drives the first wheel 112 through the first bevel gearbox 108 and the second motor 126 drives the second wheel 118 through the second bevel gearbox 114. Additional motors and wheels can be added where each motor drives a single wheel. Due the necessity of a motor for every wheel, the known staggered downhole tractor drive module 100 has a very long length. The long length of the known staggered downhole tractor drive module 100 makes it uncompetitive for operations where shorter downhole tractor drive modules are needed. For example, when wellbores have tight turns or short straight areas, the known staggered downhole tractor drive module 100 can be ineffective at navigating the wellbore or can become stuck within the wellbore.

Figure 3A:
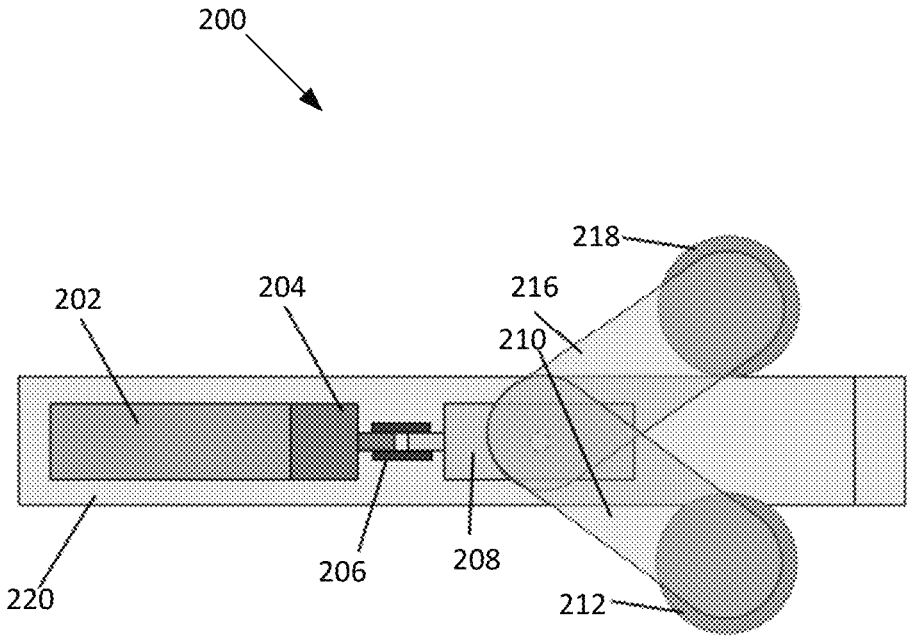
PRIOR ART FIG. 3A
FIG. 3A illustrates a downhole tractor drive module in a scissor configuration.
Figure 3B:
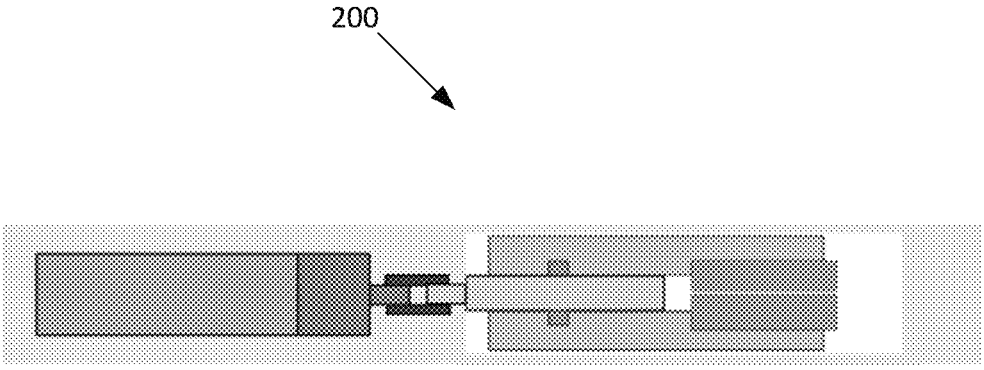
PRIOR ART FIG. 3B
FIG. 3B illustrates a downhole tractor drive module in a scissor configuration.

FIGS. 3A-3B illustrate a known scissor downhole tractor drive module 200. The known scissor downhole tractor drive module 200 can include a motor 202 with a motor gearbox 204, a coupling mechanism 206, a bevel gearbox 208, a first drive arm 210, a first wheel 212, a second drive arm 216, and a second wheel 218. The known scissor downhole tractor drive module 200 can further include a housing 220. The bevel gearbox 208 can transmit power from the motor 202, via the motor gearbox 204, to the first wheel 212 through the first drive arm 210 and to the second wheel 218 through the second drive arm 216.

The known scissor downhole tractor drive module 200 requires that the first drive arm 210 and the second drive arm 216 share the same space within the housing 220. By sharing the same space, the transmissions in the first drive arm 210 and the second drive arm 216 must be small in order to fit within the space (e.g., have shorter heights than if only one drive arm was used in the space). The small transmissions are weaker and therefore break easier than the transmissions of the drive arms in the known staggered downhole tractor drive module 100. Further, the housing 220 structural integrity is weaker, since the housing 220 must have two openings located at the same position along the housing 220 (i.e., same position along the length of the housing 220) in order to allow both the first drive arm 210 and second drive arm 216 to extend out from the housing 220 and contact the surface of the wellbore.

Figure 4A:
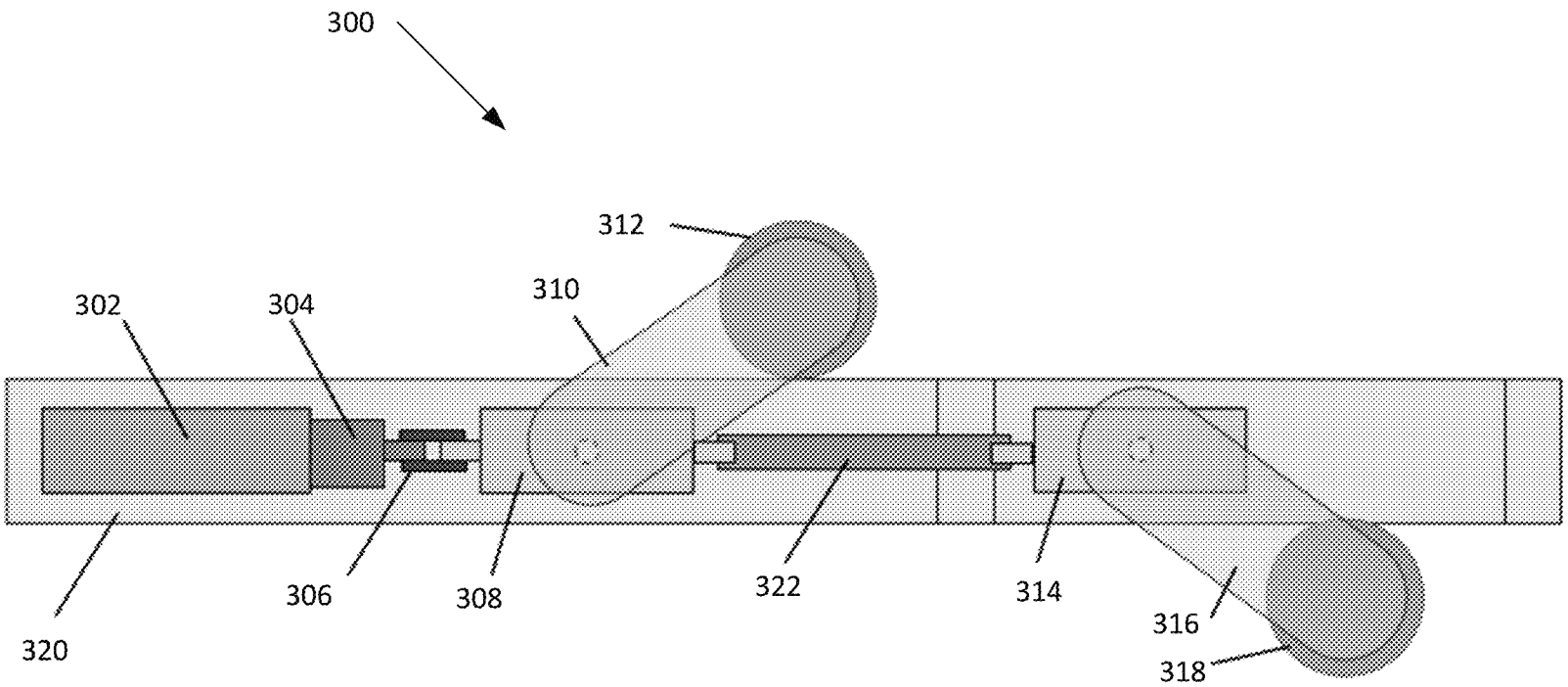
FIG. 4A illustrates a downhole tractor drive module configuration according to the present disclosure.
Figure 4B:
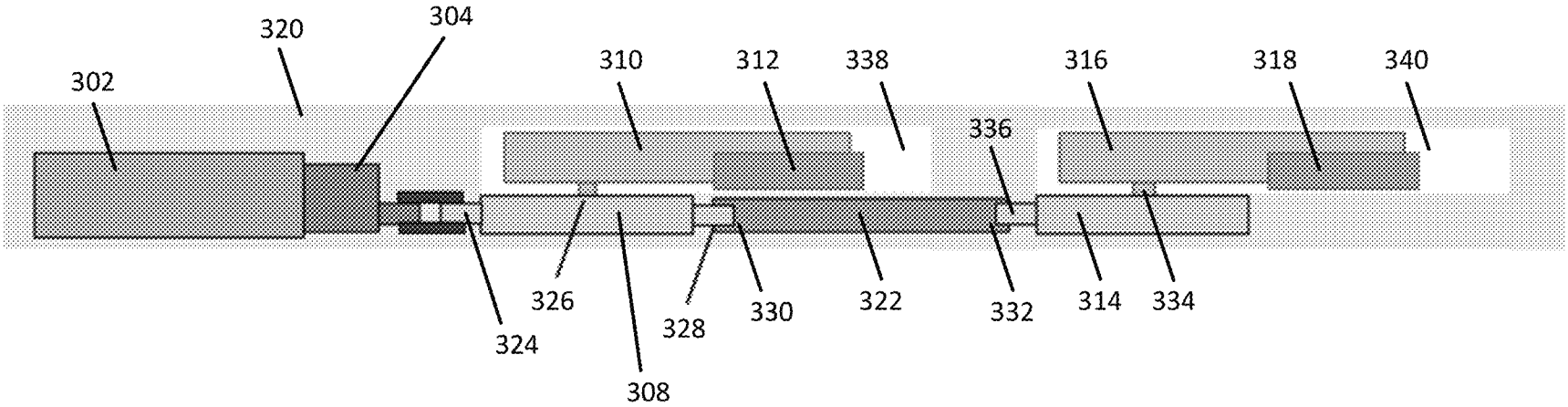
FIG. 4B illustrates a downhole tractor drive module configuration according to the present disclosure.

FIGS. 4A-4B illustrate a downhole tractor drive module 300, according to the present technology, which overcomes the limitations of the known staggered downhole tractor drive module 100 and the known scissor downhole tractor drive module 200. The downhole tractor drive module 300 can be defined as a modified stagger configuration downhole tractor drive module. As illustrated in FIG. 4A, the downhole tractor drive module 300 can include a motor 302 with a motor gearbox 304, a coupling mechanism 306, a first bevel gearbox 308, a first drive arm 310, a first wheel 312, a connecting shaft 322, a second bevel gearbox 314, a second drive arm 316, a second wheel 318, and a housing 320. The first bevel gearbox 308 can be located closer to the motor 302 than the second bevel gearbox 314. The first bevel gearbox 308 can be operable to receive 100% of the power from the motor 302 and transmit a portion of the power to the second bevel gearbox 314.

As illustrated in FIG. 4B, the first bevel gearbox 308 can have an input shaft 324, a first output shaft 326, and a second output shaft 328. The second bevel gearbox 314 can have an input shaft 336 and a second bevel gearbox output shaft 334. In some examples, the second bevel gearbox 314 can include a second output shaft. The connecting shaft 322 can include a connecting shaft input connection 330 (e.g., a coupling mechanism) and a connecting shaft output connection 332 (e.g., a coupling mechanism). The connecting shaft input connection 330 can be coupled to the second output shaft 328 of the first bevel gearbox 308. The connecting shaft output connection 332 can be coupled to the input shaft 336 of the second bevel gearbox 314. The input shafts and output shafts of the first bevel gearbox 308 and the second bevel gearbox 314 can be coupled to the other components described herein using coupling mechanisms. The coupling mechanisms can be rigid couplers, flexible couplers, and/or other couplers known in the art.

The motor 302 can include a motor gearbox 304. In some examples, the motor 302 can be an electric motor or other motors known in the art operable to drive the motor gearbox 304. The motor gearbox 304 can have an output shaft operable to provide the power from the motor 302 to the input shaft 324 of the first bevel gearbox 308. The coupling mechanism 306 can couple the output shaft of the motor gearbox 304 to the input shaft 324 of the first bevel gearbox 308, thereby putting the motor 302 in communication with the input shaft 324 of the first bevel gearbox 308. The motor gearbox 304 can have one or more gears defining a gear system. The motor gearbox 304 can provide the mechanical power to the input shaft 324 of the first bevel gearbox 308. In another example, the motor 302 does not require a motor gearbox 304 and can provide power directly to the input shaft 324 of the first bevel gearbox 308.

The input shaft 324 of the first bevel gearbox 308 is configured to receive 100% of the power provided by the motor 302. The first bevel gearbox 308 can convert the power supplied by the motor 302 into two separate power output shafts (e.g., first output shaft 326 and second output shaft 328). In some examples, the bevel gearbox 308 can split the power provided by the motor 302 equally or substantially equally between the first output shaft 326 and the second output shaft 328. For example, the first bevel gearbox 308 can provide about 50% of the power from the motor 302 to the first output shaft 326 and about 50% of the power from the motor 302 to the second output shaft 328. In other examples, the power may be split unequally between the first output shaft 326 and the second output shaft 328. The first bevel gearbox 308 can have one or more gears and/or a gear system for splitting the power provided to the input shaft 324 between the first output shaft 326 and the second output shaft 328.

The power provided to the first output shaft 326 can be provided to the first drive arm 310 by coupling the first output shaft 326 to the first drive arm 310. The first drive arm 310 can have a transmission internal to the first drive arm 310 and a first wheel 312 at a distal end of the first drive arm 310. The transmission can be configured to provide the power from the first output shaft 326 of the first bevel gearbox 308 to the first wheel 312, thereby causing the first wheel 312 to rotate. In some examples, the transmission of the first drive arm 310 can include any transmission configuration known in the art. For example, the transmission of the first drive arm 310 can include spur gears, chains, belts, other components known in the art, or combinations thereof. The first wheel 312 is operable to contact a surface of a well or casing, thereby providing a tractive force and propelling the downhole tractor drive module 300 in a desired direction.

The power provided to the second output shaft 328 can be provided to the connecting shaft 322. The connecting shaft 322 can have a connecting shaft input connection 330 that is coupled to the second output shaft 328 of the first bevel gearbox 308. In some examples, the connecting shaft input connection 330 is a coupling mechanism for coupling the connecting shaft 322 to the second output shaft 328 of the first bevel gearbox 308. The connecting shaft 322 can have a connecting shaft output connection 332 (e.g., coupling mechanism). The connecting shaft output connection 332 can be coupled to an input shaft 336 of the second bevel gearbox 314. The power provided by the second output shaft 328 of the first bevel gearbox 308 causes the connecting shaft 322 to rotate. The rotation of the connecting shaft 322 causes the input shaft 336 of the second bevel gearbox 314 to rotate (e.g., the connecting shaft 322 translates power from the second output shaft 328 of the first bevel gearbox 308 to the input shaft 336 of the second bevel gearbox 314). In this manner, power from the motor 302 is provided to the second bevel gearbox 314, thereby removing the need for a second motor and shortening the length of the downhole tractor drive module 300.

The second bevel gearbox 314 can include the input shaft 336 and a second bevel gearbox output shaft 334. The second bevel gearbox 314 can provide power to the second drive arm 316 via the second bevel gearbox output shaft 334 by coupling the second drive arm 316 to the second bevel gearbox output shaft 334. The second drive arm 316 can have a second wheel 318 at a distal end of the second drive arm 316. The second drive arm 316 can have a transmission. The transmission in the second drive arm 316 can receive the power from the second bevel gearbox output shaft 334 of the second bevel gearbox 314 and provide power to the second wheel 318, thereby causing the second wheel 318 to rotate. In some examples, the transmission of the second drive arm 316 can include any transmission configuration known in the art. For example, the transmission of the second drive arm 316 can include spur gears, chains, belts, other components known in the art, or combinations thereof. The second wheel 318 is operable to contact the surface of a well or casing, thereby providing a tractive force and propelling the downhole tractor drive module 300 in a desired direction.

The first drive arm 310 and the second drive arm 316 can be configured to operate on opposite sides of the downhole tractor drive module 300. For example, the first drive arm 310 and the second drive arm 316 can be configured to operate in a horizontal configuration (e.g., first drive arm 310 operating on a left side of the downhole tractor drive module 300 and second drive arm 316 operating on a right side of the downhole tractor drive module 300, or vice versa) or in a vertical configuration (e.g., first drive arm 310 operating on an upper side of the downhole tractor drive module 300 and second drive arm 316 operating on a lower side of the downhole tractor drive module 300, or vice versa). Other configurations of the first drive arm 310 and the second drive arm 316 besides a horizontal or vertical configuration can be used depending on the application.

The first wheel 312 and the second wheel 318 can be configured to rotate in opposite directions to propel the downhole tractor drive module 300 forward. This can be accomplished by the internal components of the first bevel gearbox 308 providing a rotation direction of the second output shaft 328 opposite the rotation direction of the input shaft 324. For example, the motor gearbox 304 can provide a clockwise rotation to the input shaft 324 of the first bevel gearbox 308. The first bevel gearbox 308 can have a gear system that translates the power provided to the input shaft 324 in a clockwise direction to a counterclockwise rotation of the second output shaft 328. Since the rotation of the second output shaft 328 is opposite the rotation of the input shaft 324, the rotation of the connecting shaft 322 and thereby the rotation of the input shaft 336 of the second bevel gearbox 314 will be opposite of the rotation of the input shaft 324 of the first bevel gearbox 308. In this example, the first bevel gearbox 308 and the second bevel gearbox 314 can have the same internal gear system, therefore the rotation direction of the input shafts 324, 336 determines the rotation direction of the first output shafts 326, 334. Similarly, the transmissions of the first drive arm 310 and the second drive arm 316 can be the same and provide different wheel rotation directions to the first wheel 312 and the second wheel 318, respectively, due to the different rotation directions of the first output shafts 326, 334.

The housing 320 can be operable to enclose or contain the downhole tractor drive module 300. By enclosing or containing the downhole tractor drive module 300, the housing 320 protects the interior components of the downhole tractor drive module 300 and does not allow any debris or other materials from entering the components of the downhole tractor drive module 300. Debris or other materials can cause the downhole tractor drive module 300 to malfunction.

The housing 320 can include a first opening 338 and a second opening 340. The first opening 338 can be operable to allow the first drive arm 310 and thereby the first wheel 312 to extend out from the housing 320 and contact a surface of the casing and/or wellbore. The second opening 340 can be operable to allow the second drive arm 316 and thereby the second wheel 318 to extend out from the housing 320 and contact a surface of the casing and/or wellbore. The first opening 338 and the second opening 340 can be located on opposite sides of the housing 320. The first opening 338 and the second opening 340 can be staggered along the length of the housing 320 (e.g., have different locations along the length of the housing 320). Therefore, the first drive arm 310 and the second drive arm 316 are staggered along the length of the downhole tractor drive module 300. By locating the first drive arm 310 and the second drive arm 316 at different locations along the length of the downhole tractor drive module 300, the first drive arm 310 and the second drive arm 316 can each have a separate space to operate. Giving the first drive arm 310 and the second drive arm 316 separate spaces to operate prevents binding actions between the first drive arm 310 and the second drive arm 316. Further, the strength and structural integrity of the transmissions are maintained as compared to the known scissor downhole tractor drive module 200, since the first drive arm 310 and the second drive arm 316 can have greater heights within the housing 320, thereby allowing more space for stronger components. For example, the housing 320 can have the same height as the housing 220 but since the known scissor downhole tractor drive module 200 requires the first drive arm 210 and the second drive arm 216 to be positioned at the same location along the housing, the height of the first drive arm 210 and the second drive arm 216 can be approximately half of the height of the first drive arm 310 and the second drive arm 316 of the downhole tractor drive module 300.

The first drive arm 310 can be coupled to the first bevel gearbox 308 via a first pivot, as well as at the first output shaft 326. In some examples, the first pivot and the first output shaft 326 of the first bevel gearbox 308 can be the same component or different components. The first pivot can have a pivot mechanism operable to pivot the first drive arm 310 from a collapsed position to an extended position. In the collapsed position, the first drive arm 310 can be contained within the housing 320. In the extended position, the first drive arm 310 can extend out from the housing 320 through the first opening 338. The pivot mechanism can be a hydraulic mechanism, mechanical mechanism, or other type of pivot mechanism. The pivot mechanism can be in communication with a controller operable to control the pivot mechanism and thereby the first drive arm 310 between the collapsed position and the extended position. In some examples, the first drive arm 310 can be in a collapsed position while the downhole tractor drive module 300 is lowered into a wellbore. Once the downhole tractor drive module 300 is located at a position in the wellbore where the downhole tractor drive module 300 is needed to propel tools or a tool string through the wellbore, the pivot mechanism can be actuated to move the first drive arm 310 to the extended position.

The second drive arm 316 can be coupled to the second bevel gearbox 314 via a second pivot, as well as the second bevel gearbox output shaft 334. In some examples, the second pivot and the second bevel gearbox output shaft 334 of the second bevel gearbox 314 can be the same component or different components. The second pivot can have a pivot mechanism operable to pivot the second drive arm 316 from a collapsed position to an extended position. In the collapsed position, the second drive arm 316 can be contained within the housing 320. In the extended position, the second drive arm 316 can extend out from the housing 320 through the second opening 340. The pivot mechanism can be a hydraulic mechanism, mechanical mechanism, or other type of pivot mechanism. The pivot mechanism can be in communication with a controller operable to control the pivot mechanism and thereby the second drive arm 316 between the collapsed position and the extended position. In some examples, the second drive arm 316 can be in a collapsed position while the downhole tractor drive module 300 is lowered into a wellbore. Once the downhole tractor drive module 300 is located at a position in the wellbore where the downhole tractor drive module 300 is needed to propel tools or a tool string through the wellbore, the pivot mechanism can be actuated to move the second drive arm 316 to the extended position.

The controller can also be in communication with the motor 302. The controller can be operable to control the amount of power provided by the motor 302 to the first bevel gearbox 308. The amount of power provided to the first bevel gearbox can determine the rotation speed of the first wheel 312 and the second wheel 318 and thereby control the speed at which the downhole tractor drive module 300 moves. The speed at which the downhole tractor drive module 300 moves can be controlled to ensure that the tools and/or tool strings maintain a workable condition and do not erratically bounce or move within the wellbore.

The second bevel gearbox 314 can further include a second output shaft. The downhole tractor drive module 300 can be modified to include an additional bevel gearbox, drive arm, and wheel by connecting the additional bevel gearbox to the second output shaft of the second bevel gearbox 314 via a second connecting shaft. It will be appreciated that the components of the downhole tractor drive module 300 can be duplicated to include 1, 2, 3, 4, 5, 6, or more additional bevel gearboxes, drive arms, wheels, and connecting shafts.

Figure 5:
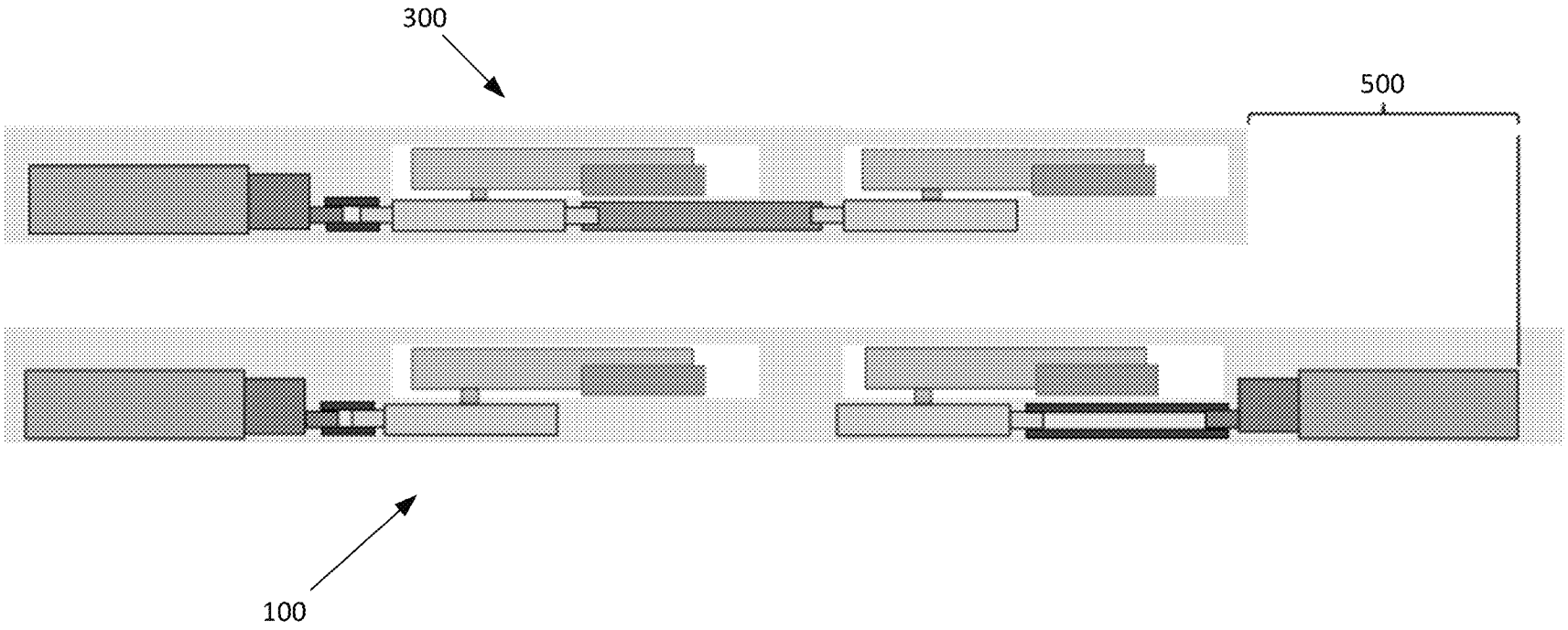
FIG. 5 illustrates a length comparison between the downhole tractor drive module of the present disclosure and a downhole tractor drive module in a staggered configuration.

FIG. 5 illustrates the length difference 500 between the downhole tractor drive module 300 and the known staggered downhole tractor drive module 100. The length difference 500 is due to the omission of the second motor 126, second motor gearbox 124, and second coupling mechanism 122. As described herein, the downhole tractor drive module 300 does not need a separate motor for each drive arm. The downhole tractor drive module 300 utilizes a first bevel gearbox 308 having a second output shaft 328 and a connecting shaft 322 for powering the second bevel gearbox 314. In some examples, the length difference 500 can be about 12 inches to about 16 inches. In another example, the length difference 500 can be about 12 inches to about 13 inches, about 13 inches to about 14 inches, about 14 inches to about 15 inches, about 15 inches to about 16 inches, or more. The reduced length of the downhole tractor drive module 300 can be beneficial in applications where shorter downhole tractor drive modules are needed.

It will be appreciated that multiple downhole tractor drive modules 300 can be used in a single operation. For example, multiple downhole tractor drive modules 300 can provide additional control over the movement of the tractor and the tools or tool strings. One downhole tractor drive module 300 may be used with two drive arms in a horizontal configuration and another downhole tractor drive module 300 may be used with two drive arms in a vertical configuration. Multiple additional downhole tractor drive modules 300 with different orientations/configurations of drive arms can be combined to control the motion of the tractor and the tools and tools strings.

Numerous examples are provided herein to enhance understanding of the present disclosure. A specific set of statements are provided as follows.

Statement 1: A downhole tractor drive module, the downhole tractor drive module comprising: a motor, a first bevel gearbox proximal to the motor, the first bevel gearbox having an input shaft, a first output shaft, and a second output shaft, the input shaft of the first bevel gearbox in communication with the motor; a first drive arm coupled to the first bevel gearbox; a connecting shaft having a connecting shaft input connection and a connecting shaft output connection, the connecting shaft input connection coupled to the second output shaft of the first bevel gearbox; a second bevel gearbox distal to the motor, the second bevel gearbox having an input shaft and a first output shaft, the input shaft of the second bevel gearbox coupled to the connecting shaft output connection; and a second drive arm coupled to the second bevel gearbox.

Statement 2: A downhole tractor drive module as disclosed in Statement 1, the downhole tractor drive module further comprising a housing to enclose the downhole tractor drive module, wherein the housing comprises: a first opening operable to allow the first drive arm to extend outside of the housing; and a second opening operable to allow the second drive arm to extend outside of the housing.

Statement 3: A downhole tractor drive module as disclosed in Statements 1 or 2, wherein the downhole tractor drive module further comprises a motor gearbox coupled, via a coupling mechanism, to the motor and the input shaft of the first bevel gearbox.

Statement 4: A downhole tractor drive module as disclosed in any of preceding Statements 1-3, wherein the second bevel gearbox further comprises a second output shaft.

Statement 5: A downhole tractor drive module as disclosed in any of preceding Statements 1-4, wherein the input shaft of the first bevel gearbox is configured to receive 100% of a power provided by the motor.

Statement 6: A downhole tractor drive module as disclosed in any of preceding Statements 1-5, wherein the first bevel gearbox is configured to split a power provided by the motor substantially equally between the first output shaft and the second output shaft of the first bevel gearbox.

Statement 7: A downhole tractor drive module as disclosed in Statement 6, wherein the power provided to the second output shaft of the first bevel gearbox is translated through rotation of the connecting shaft to the input shaft of the second bevel gearbox, and wherein the connecting shaft rotates in a direction opposite of a rotation of the input shaft of the first bevel gearbox.

Statement 8: A downhole tractor drive module as disclosed in Statement 7, wherein the first drive arm comprises a first wheel at a distal end of the first drive arm and the second drive arm comprises a second wheel at a distal end of the second drive arm.

Statement 9: A downhole tractor drive module as disclosed in Statement 8, wherein the first drive arm further comprises a transmission operable to receive the power from the first output shaft of the first bevel gearbox and cause the first wheel to rotate.

Statement 10: A downhole tractor drive module as disclosed in Statements 8 or 9, wherein the second drive arm further comprises a transmission operable to receive the power from the first output shaft of the second bevel gearbox and cause the second wheel to rotate.

Statement 11: A downhole tractor drive module as disclosed in any of preceding Statements 8-10, wherein the first wheel and the second wheel are operable to rotate in opposite directions.

Statement 12: A downhole tractor drive module as disclosed in any of preceding Statements 1-11, wherein the first drive arm and the second drive arm are staggered and are configured to operate on opposite sides of the downhole tractor drive module.

Statement 13: A downhole tractor drive module as disclosed in any of preceding Statements 1-12, wherein the first bevel gearbox further comprises a first pivot operable to couple to the first drive arm, the first pivot operable to rotate the first drive arm.

Statement 14: A downhole tractor drive module as disclosed in any of preceding Statements 1-13, wherein the second bevel gearbox further comprises a second pivot operable to couple to the second drive arm, the second pivot operable to rotate the second drive arm.

Statement 15: A downhole tractor drive module, the downhole tractor drive module comprising: a motor; a first bevel gearbox proximal to the motor, the first bevel gearbox having an input shaft, a first output shaft, and a second output shaft, the input shaft of the first bevel gearbox in communication with the motor; a first drive arm coupled to the first bevel gearbox, the first drive arm having a first wheel at a distal end of the first drive arm; a connecting shaft having a connecting shaft input connection and a connecting shaft output connection, the connecting shaft input connection coupled to the second output shaft of the first bevel gearbox; a second bevel gearbox distal to the motor, the second bevel gearbox having an input shaft and a first output shaft, the input shaft of the second bevel gearbox coupled to the connecting shaft output connection; and a second drive arm coupled to the second bevel gearbox, the second drive arm having a second wheel at a distal end of the second drive arm.

Statement 16: A downhole tractor drive module as disclosed in Statement 15, wherein the input shaft of the first bevel gearbox is configured to receive 100% of a power provided by the motor.

Statement 17: A downhole tractor drive module as disclosed in Statements 15 or 16, wherein the first bevel gearbox is configured to split a power provided by the motor substantially equally between the first output shaft and the second output shaft of the first bevel gearbox.

Statement 18: A downhole tractor drive module as disclosed in Statement 17, wherein the power provided to the second output shaft of the first bevel gearbox is translated through rotation of the connecting shaft to the input shaft of the second bevel gearbox, and wherein the connecting shaft rotates in a direction opposite of the input shaft of the first bevel gearbox.

Statement 19: A downhole tractor drive module as disclosed in Statement 18, wherein the first drive arm further comprises a first drive arm transmission operable to provide power to the first wheel from the first output shaft of the first bevel gearbox.

Statement 20: A downhole tractor drive module as disclosed in Statement 19, wherein the second drive arm further comprises a second drive arm transmission operable to provide power to the second wheel from the first output shaft of the second bevel gearbox.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A downhole tractor drive module, the downhole tractor drive module comprising:

a motor;

a first bevel gearbox having an input shaft, a first output shaft, and a second output shaft, the input shaft of the first bevel gearbox in communication with the motor;

a first drive arm coupled to the first bevel gearbox;

a connecting shaft having a connecting shaft input connection and a connecting shaft output connection, the connecting shaft input connection coupled to the second output shaft of the first bevel gearbox;

a second bevel gearbox, the second bevel gearbox having an input shaft and a first output shaft, the input shaft of the second bevel gearbox coupled to the connecting shaft output connection, such that the first bevel gearbox is closer to the motor than the second bevel gearbox; and a second drive arm coupled to the second bevel gearbox, wherein the first bevel gearbox is configured to split power provided by the motor substantially equally between the first output shaft and the second output shaft of the first bevel gearbox, and wherein the power provided to the second output shaft of the first bevel gearbox is translated through rotation of the connecting shaft to the input shaft of the second bevel gearbox, and wherein the connecting shaft rotates in a direction opposite of a rotation of the input shaft of the first bevel gearbox.

2. The downhole tractor drive module of claim 1, the downhole tractor drive module further comprising a housing to enclose the downhole tractor drive module, wherein the housing comprises:

a first opening operable to allow the first drive arm to extend outside of the housing; and a second opening operable to allow the second drive arm to extend outside of the housing.

3. The downhole tractor drive module of claim 1, wherein the downhole tractor drive module further comprises a motor gearbox coupled, via a coupling mechanism, to the motor and the input shaft of the first bevel gearbox.

4. The downhole tractor drive module of claim 1, wherein the second bevel gearbox further comprises a second output shaft.

5. The downhole tractor drive module of claim 1, wherein the input shaft of the first bevel gearbox is configured to receive 100% of a power provided by the motor.

6. The downhole tractor drive module of claim 1, wherein the first drive arm comprises a first wheel at a distal end of the first drive arm and the second drive arm comprises a second wheel at a distal end of the second drive arm.

7. The downhole tractor drive module of claim 6, wherein the first drive arm further comprises a transmission operable to receive the power from the first output shaft of the first bevel gearbox and cause the first wheel to rotate.

8. The downhole tractor drive module of claim 6, wherein the second drive arm further comprises a transmission operable to receive the power from the first output shaft of the second bevel gearbox and cause the second wheel to rotate.

9. The downhole tractor drive module of claim 6, wherein the first wheel and the second wheel are operable to rotate in opposite directions.

10. The downhole tractor drive module of claim 1, wherein the first drive arm and the second drive arm are staggered and are configured to operate on opposite sides of the downhole tractor drive module.

11. The downhole tractor drive module of claim 1, wherein the first bevel gearbox further comprises a first pivot operable to couple to the first drive arm, the first pivot operable to rotate the first drive arm.

12. The downhole tractor drive module of claim 1, wherein the second bevel gearbox further comprises a second pivot operable to couple to the second drive arm, the second pivot operable to rotate the second drive arm.

13. A downhole tractor drive module, the downhole tractor drive module comprising:

a motor;

a first bevel gearbox having an input shaft, a first output shaft, and a second output shaft, the input shaft of the first bevel gearbox in communication with the motor;

a first drive arm coupled to the first bevel gearbox, the first drive arm having a first wheel at a distal end of the first drive arm;

a connecting shaft having a connecting shaft input connection and a connecting shaft output connection, the connecting shaft input connection coupled to the second output shaft of the first bevel gearbox;

a second bevel gearbox having an input shaft and a first output shaft, the input shaft of the second bevel gearbox coupled to the connecting shaft output connection, such that the first bevel gearbox is closer to the motor than the second bevel gearbox; and a second drive arm coupled to the second bevel gearbox, the second drive arm having a second wheel at a distal end of the second drive arm, wherein the first bevel gearbox is configured to split power provided by the motor substantially equally between the first output shaft and the second output shaft of the first bevel gearbox, and wherein the power provided to the second output shaft of the first bevel gearbox is translated through rotation of the connecting shaft to the input shaft of the second bevel gearbox, and wherein the connecting shaft rotates in a direction opposite of the input shaft of the first bevel gearbox.

14. The downhole tractor drive module of claim 13, wherein the input shaft of the first bevel gearbox is configured to receive 100% of a power provided by the motor.

15. The downhole tractor drive module of claim 13, wherein the first drive arm further comprises a first drive arm transmission operable to provide power to the first wheel from the first output shaft of the first bevel gearbox.

16. The downhole tractor drive module of claim 15, wherein the second drive arm further comprises a second drive arm transmission operable to provide power to the second wheel from the first output shaft of the second bevel gearbox.

* * * * *